United States Patent [19]

Dufour

[11] Patent Number: 4,962,596

[45] Date of Patent: Oct. 16, 1990

[54] SPORT SHOE SOLE

[75] Inventor: Pierre Dufour, Menthon-St-Bernard, France

[73] Assignee: Salomon S. A., Annecy Cedex, France

[21] Appl. No.: 288,066

[22] Filed: Dec. 22, 1988

[30] Foreign Application Priority Data

Dec. 22, 1987 [FR] France ..... 87 18334

[51] Int. Cl.[5] ..... A43B 5/00; A43C 13/04

[52] U.S. Cl. ..... 36/134; 36/67 A; 36/127

[58] Field of Search ..... 36/127, 134, 67 R, 67 A, 36/67 B, 67 D

[56] References Cited

U.S. PATENT DOCUMENTS

| | | | |
|---|---|---|---|
| 4,667,422 | 5/1987 | Yamaguchi | 36/67 A |
| 4,674,207 | 6/1987 | Yamaguchi | 36/67 R |

FOREIGN PATENT DOCUMENTS

| | | | |
|---|---|---|---|
| 1485864 | 2/1970 | Fed. Rep. of Germany | 36/67 A |
| 7501105 | 5/1983 | Fed. Rep. of Germany . | |
| 3233900 | 3/1984 | Fed. Rep. of Germany | 36/67 R |
| 59-28092 | 2/1984 | Japan . | |
| 706024 | 3/1954 | United Kingdom | 36/67 A |
| 1295497 | 11/1972 | United Kingdom | 36/127 |
| 1355675 | 6/1974 | United Kingdom | 36/67 A |

*Primary Examiner*—James Kee Chi

*Attorney, Agent, or Firm*—Pollock, Vande Sande & Priddy

[57] ABSTRACT

Shoe sole equipped with studs 2 comprising a base 4 and a head 2. The base 4 is inserted into the sole and held in a position such that its lower surface 5 is kept flush with the walking surface 6 of the sole by a means of insertion 11 which is recessed from said lower surface. The tip of the stud is connected to this lower surface by means of a curved surface 7 whose arched shape is tangent to said surface 5 and which rises toward the head cover at least the first third 8 of the functional height 9 of the stud.

13 Claims, 3 Drawing Sheets

FIG. 1
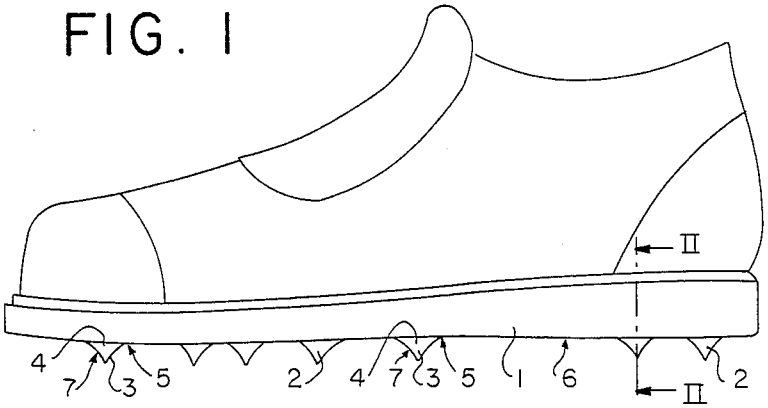
FIG. 2
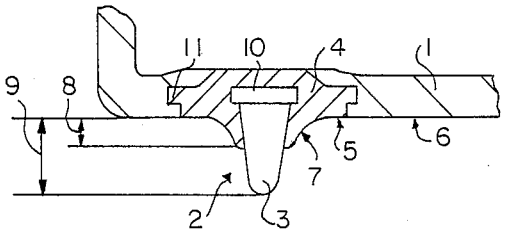
FIG. 3
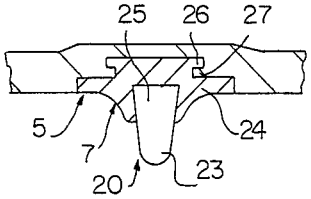
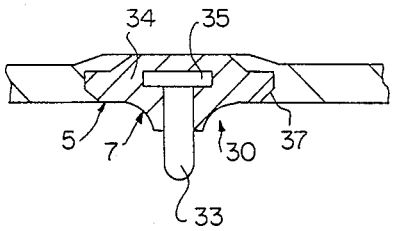
FIG. 4

SPORT SHOE SOLE

FIELD OF THE INVENTION

The present invention concerns sports shoes of the type comprising studded soles and especially golf-shoe soles.

BACKGROUND OF THE INVENTION

Soles equipping sports shoes of this type are subjected to relatively intensive use and abrasion because of the nature and the variety of golf courses, more commonly called "greens," and by the great distances covered. Users remark particularly on the rapid wearing, and indeed even of the breakage, of the stud heads, as well as on the accumulation of dirt and grass which stick to the bases of the studs, thereby reducing their functional life. Furthermore, because the number of studs under the walking sole is limited, the supporting surface provided by this sole becomes greatly reduced, especially on hard courses where gripping is exerted only by the heads of the studs. As a result, the pressures channelled to the studs often cause deformations of the sole, which produce painful sensations on the golfer's soles.

A large number of studded soles intended in particular for golfing have been designed so as to ensure conditions which facilitate the gripping of the ground. In addition, some soles are equipped with studs whose heads are made of a relatively hard material to reduce wear and tear.

The Japanese Patent No. 59.28902 may be cited as an example. This patent describes both studs whose structure may comprise heads of a hard material and methods for fastening such studs within the thickness of the shoe sole. As the drawings show, the hard head of the stud is not anchored in the body of the stud, whose point of attachment, in a first illustrated case, is greatly recessed from the tip and from the walking surface, or, in a second illustrated case, is almost flush with said walking surface and exerts a renewed gripping action on the walking surface by means of a raised flange. A structure and an fastening system of this kind do not protect against the possible loss of the hard tip, given the absence of anchoring, and they do not prevent the accumulation of dirt and/or grass, since the connection of said tip in relation to the walking surface forms a sharp angle, i.e., a raised edge.

Other studded soles, of the type described in the German Patent Application No. Dgm 75 01 105, comprise studs whose attachment within the sole is composed of a dovetail slide-track, and whose heads, substantially in the shape of a conical frustum, are attached at a sharp angle to said studs. A stud design of this type, according to which the base is flush with the walking surface of the sole, does not lessen the risks of accumulating dirt, and proves to be relatively complicated and troublesome because of the means of attachment.

SUMMARY OF THE INVENTION

The present invention proposes to remedy these difficulties simply and effectively by ensuring the permanent mounting of the stud in a position flush with the walking surface and by structuring the hard-tipped stud in such a way that the attachment of the tip to the stud body is shaped progressively in the form of a curved surface, thereby avoiding the fouling of the studs by dirt and/or grass.

The shoe sole according to the invention is equipped with studs inserted at least partially into the sole thickness by means of a base acting as a means of anchoring; this base is held in a position such that its lower surface is kept flush with the walking surface of the sole by a means of insertion composed of a flange recessed from said lower surface, which extends progressively toward the stud tip by at least one curved, connecting surface, this surface having the shape of an arc tangent to said lower surface and extending toward said tip, rising over at least the first third of the functional height of the stud.

In one embodiment of the stud, the head is formed of a material which is harder than the material composing the stud base, and the head is partially inserted into the stud; it is held in place by a means of anchoring, comprising, for example, a flange, a swelling, etc., with which it is equipped at the corresponding end, while its other end extends beyond the curved, connecting surface which rises from the lower surface of the stud and constitutes a protective sheath for the head.

BRIEF DESCRIPTION OF THE DRAWINGS

The invention will, moreover, be better understood by referring to the following description in relation to the attached schematic drawings which, provided as non-limiting examples, show embodiments of a studded sole which matches the present one.

FIG. 1 shows a shoe comprising a studded sole according to the invention.

FIG. 2 is a partial, enlarged cross-section of the sole shown in FIG. 1 along the line II—II.

FIGS. 3, 4, and 5 illustrate different embodiments of the stud structure.

DESCRIPTION OF THE PREFERRED EMBODIMENTS

Figure 5:
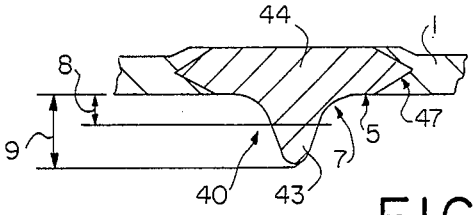

As shown in FIG. 1, the shoe comprises a walking sole 2 equipped with studs 2. In accordance with the invention, these studs 2 have a head 3 and a base 4, whose bottom surface 5 is flush with the walking surface 6 of the sole 1; the bottom surface 5 of the base 4 extends toward the tip 3 progressively by at least one curved, connecting surface 7. This curved, connecting surface 7, as shown in FIG. 2, is an arc-shaped section tangent to the bottom surface 5 of the base 4, and which rises toward the tip 3 over at least the first third 8 of the functional height 9 of the stud 2. The functional height 9 is measured from the end of the tip 3 to the bottom surface 5 of the stud base 4, which is itself flush with the walking surface 6 of the sole 1. The structure of the stud 2 shown in this embodiment indicates that the tip 3 is made up of an element different from that of the base 4 of the stud 2; the tip 3, which may in particular be formed from a hard material which is relatively abrasion-resistant, such as ceramics or a hard metal, is kept anchored in the base by its conical shape and by its flange 10. The maintenance of the position of the stud 2 anchored in the thickness of the sole 1 and flush with the walking surface 6 of that sole is assured by means of a flange 11 constituting the means of insertion; since this flange is recessed from the bottom surface 5 of the base 4 of the stud, the material making up the sole 1 covers the sole over the entire perimeter of the base 4, thus ensuring its anchoring. The base 4 has, preferably, the shape of a disk that is relatively wide in relation to the head and the curved, connecting surface, thereby allowing the pressure exerted on the tip to be spread out over a larger surface and thus minimizing the risk of deformation of the sole 1. It should be well understood that the anchoring of the tip 3 of the stud 2 in the base 4, and the anchoring of this base in the sole 1, may be accomplished using different, but equivalent, systems.

Thus, in the embodiment shown in FIG. 3, the stud 20 has a conical tip 23 which is held in the base 24 simply by its enlarged base 25, while the base 24 is held in position in the sole 1 by means of a flange 26 attached to this base and which is marked off by a groove 27 constituting the means of insertion; this flange 26 is formed from the massive portion of the base 24 on the side opposite to the tip. The bottom surface 5 of the base 4 is attached to the tip in the manner described previously.

In FIG. 4, the tip 33 of the stud 30 is cylindrical in shape and has an anchoring flange 35 inserted in the base 4. Furthermore, the means of insertion of the base 34 consists of a chamfer 37 cut on the peripheral edge of this base and recessed from the bottom surface 5.

Still in accordance with the invention, the studs may, of course, be made of a single piece. Thus, in FIG. 5, the stud 40 has a tip 43 which is unitary with the base 44. In this embodiment, the stud has a shape identical to that of the studs previously described; here again one encounters a curved, connecting surface 7 which extends from the bottom surface 5 of the base 44 toward the point 43 to at least the first third 8 of the functional height 9 of the stud. Similarly, the means of insertion of the stud 40 may equally effectively be provided according to any of the preceding embodiments; in this case, however, it consists of a chamfer.

The tip 43 of the stud may obviously have mechanical characteristics different from those of the base 44, especially as regards treatment or coating; as an example, a treatment such as tempering or case hardening of studs made of metal may be cited.

Figure 6:
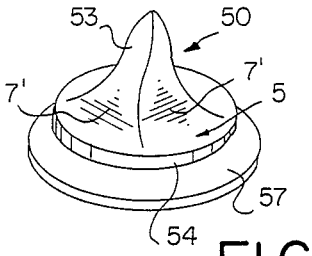
FIGS. 6 and 7 are perspective views from above of a variant embodiment of a stud.
Figure 7:
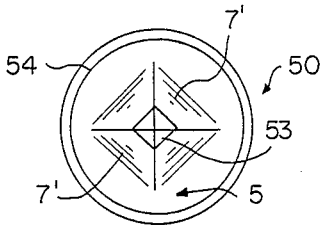

FIGS. 6 and 7 illustrate a stud 50 whose tip 53 is, as was the case in FIG. 5, unitary with the base 54. On the other hand, although the stud tips previously described had shapes obtained by rotation, the head 53 is distinguished by four curved, connecting and intersecting surfaces 7' which are tangent to the bottom surface 5, thus forming a pyramid. A stud of this kind is perfectly conceivable and may be feasibly applied to the studs shown in FIGS. 1 through 5, while not being limitative. In the embodiment shown in FIG. 6, the bottom surface 5 is marked off by a flange 57 which constitutes the means of insertion of the stud.

Figure 8:
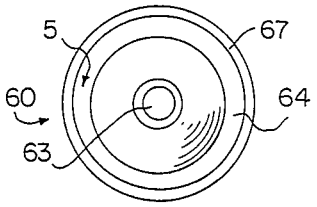
FIGS. 8, 9, and 10 are views from above of various possible embodiments of the studs.
Figure 9:
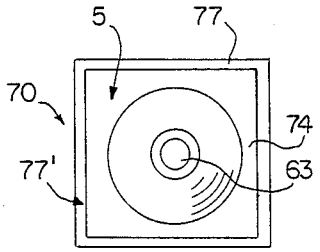
Figure 10:
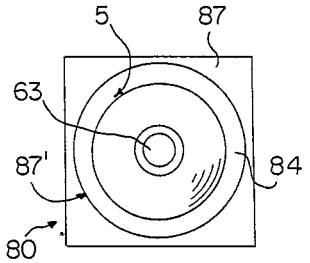

The bases of the studs may obviously take various shapes while still remaining within the sphere of the invention. Thus, in FIG. 8, the base 64 of the stud 60 may be circular in form, and the means of insertion 67, substantially concentric. Again, as shown in FIGS. 9 and 10, the bases 74 and 84 of the studs 70 and 80 may be quadrilateral in shape, while the means of insertion 77 and 87 may be extended, respectively, so as to delimit a bottom surface 5 of the stud having the shape either of a quadrilateral 77' or of a circle 87'. For all embodiments described with reference to FIGS. 8, 9, and 10, the tips 63 of the studs 60, 70, and 80 may be unitary with the base, or they may consist of a piece anchored in the base.

Figure 11:
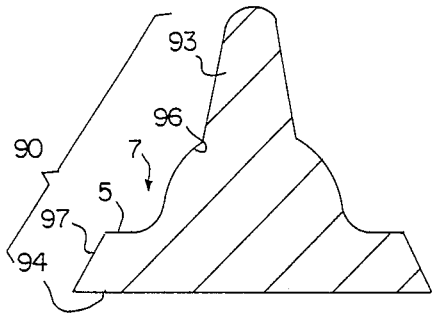
FIGS. 11, 11*a*, 12, and 12*a* show variant embodiments of the shape of the studs, all in accordance with the invention.
Figure 11A:
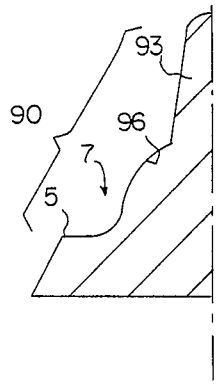

In addition, FIG. 11 shows in cross-section the general shape of a stud 90 having a curved, connecting surface 7 whose arc shape, tangent to the bottom surface 5, is connected to and extended toward the tip 93 by another section 96 also arc-shaped, but the inverse of the preceding one. In the embodiment illustrated, the two arc-shaped sections are attached together tangentially, but may, in accordance with other embodiments not shown, intersect (FIG. 11*a*).

Figure 12:
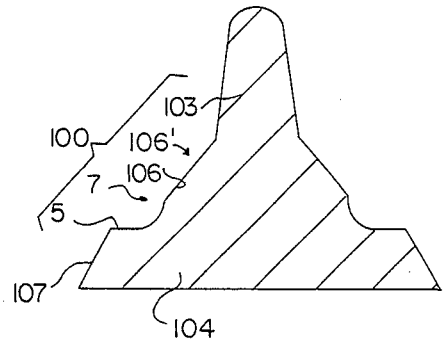

On the other hand, in FIG. 12, the stud 100 may have a curved, connecting surface 7 having an arc-shaped section which is tangent to the bottom surface 5 and which then extends at a distance from said bottom surface by means of a substantially rectilinear section whose shape 106 generates a cone 106 connecting with the tip 103 of said stud.

Figure 12A:
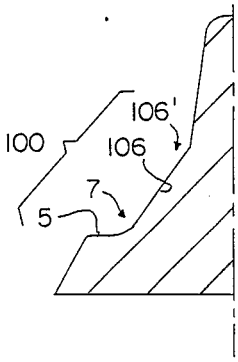

As illustrated in FIG. 12*a* and in the same construction orientation as that used for the stud 100 in FIG. 12, the substantially rectilinear outline section 106 extends tangentially the arc-shaped section rising from the bottom surface.

Finally, the outer extremity of the tips of the studs may be either rounded or pointed.

What is claimed is:

1. Sports-shoe sole equipped with studs of a harder material than a material making up the sole, said studs each comprising a base and a tip and being inserted in the sole at the level of said base, wherein the base (4, 24, 34, 44, 54, 64, 74, 84, 94, 104) of each of said studs (2, 20, 30, 40, 50, 60, 70, 80, 90, 100) is inserted in the sole and held in position in such a way that its bottom surface (5) is kept flush with a walking surface (6) of the sole (1) by a means of insertion (11, 27, 37, 47, 57, 67, 77, 87, 97, 107) which is recessed from said bottom surface, and wherein said base is extended progressively toward the tip by at least one curved, connecting surface (7, 7') having an arc-shaped section tangent to said bottom surface and extending, by means of another section, toward the tip (3, 23, 33, 43, 53, 63, 93, 103) to a point marking at least one-third of the way up a functional height (9) of the stud.

2. Sports-shoe sole according to claim 1, wherein the means of insertion (11) (57) of the stud is a flange recessed from the bottom surface (5) of the base (4) (54).

3. Sports-shoe sole according to claim 1, wherein the means of insertion (27) of the stud is a groove marking off a flange (26) recessed from the bottom surface (5) of the base and formed from the massive portion of the base in the side opposite to the tip (23).

4. Sports-shoe sole according to claim 1, wherein the means of insertion (37, 47, 97, 107) of the stud is a chamfer cut in the peripheral edge of the base (34, 44, 94, 104) and extending in a recessed manner from the bottom surface (5) of the base.

5. Sports-shoe sole according to any of one claims 1 through 4, wherein the tip (43, 53, 63, 93, 103) of the stud (40, 50, 60, 70, 80, 90, 100) is unitary with the base (44, 54, 64, 74, 84, 94, 104).

6. Sports-shoe sole according to any one of claims 1 through 4, wherein the tip (3, 23, 33, 63, 93, 103) of the studs is anchored in the base (4, 24, 34, 64, 74, 84, 94, 104).

7. Sports-shoe sole according to any one of claims 1 through 4, wherein the tip (3, 23, 33, 63, 93, 103) of the stud is formed by rotation.

8. Sports-shoe sole according to any one of claims 1 through 4, wherein the tip (53) of the stud has a generally pyramidal shape.

9. Sports-shoe sole according to any of claims 1 through 4, wherein the stud is inserted into the sole (1) during molding of the latter.

10. Sports-shoe sole according to any of claims 1 through 4, wherein the arc-shaped section of the stud (90) tangent to the bottom surface (5) connects with and extends toward the tip (93) by means of another section (96), also arc-shaped but inverse to the preceding section.

11. Sports-shoe sole according to claim 10, wherein the section (96) connects tangentially to the arc-shaped section rising from the bottom surface (5., of the stud (90).

12. Sports-shoe sole according to any of claims 1 through 4, wherein the arc-shaped section of the stud (100) tangent to the bottom surface (5) of this latter is connected and extended, at a distance from said bottom surface (5), by means of a section substantially rectilinear whose shape (106) is generative of a cone (106') connecting with the tip (103) of said stud.

13. Sports-shoe sole according to claim 12, wherein the section (106) extends tangentially the arc-shaped section rising from the bottom surface (5).

* * * * *